US008506466B2

(12) United States Patent
Douillard et al.

(10) Patent No.: US 8,506,466 B2
(45) Date of Patent: Aug. 13, 2013

(54) METHOD AND APPARATUS FOR TRANSPORTING SIGNATURES AROUND A ROLL WITHOUT INTRODUCING SKEW

(75) Inventors: Gerald Roger Douillard, Manchester, NH (US); David Elliot Whitten, Barrington, NH (US); David Clarke Pollock, Somersworth, NH (US)

(73) Assignee: Goss International Americas, Inc., Durham, NC (US)

( * ) Notice: Subject to any disclaimer, the term of this patent is extended or adjusted under 35 U.S.C. 154(b) by 57 days.

(21) Appl. No.: 13/159,909

(22) Filed: Jun. 14, 2011

(65) Prior Publication Data

US 2012/0322643 A1 Dec. 20, 2012

(51) Int. Cl.
*B31F 1/10* (2006.01)

(52) U.S. Cl.
USPC ..... 493/441; 493/405; 493/416; 493/423; 493/435; 493/450

(58) Field of Classification Search
USPC ..... 493/405, 416, 418, 423, 434, 435, 493/441, 450; 271/6, 4.05, 4.06, 4.09, 12, 271/10.06, 10.07, 10.1, 10.15
See application file for complete search history.

(56) References Cited

U.S. PATENT DOCUMENTS 612,957 A * 10/1898 Sheldon ..... 493/435
3,937,453 A * 2/1976 Hickey et al. ..... 271/4.09
4,484,982 A * 11/1984 Majaniemi ..... 162/358.3
4,746,107 A * 5/1988 Schneider et al. ..... 270/21.1
4,863,421 A * 9/1989 Loebach ..... 493/419
5,080,338 A * 1/1992 Belanger et al. ..... 270/6
5,904,094 A * 5/1999 Bredenberg ..... 101/216
6,497,084 B1 * 12/2002 Janen ..... 53/389.5
6,556,798 B2 * 4/2003 Rimai et al. ..... 399/167
6,588,739 B1 * 7/2003 Weis ..... 270/6
7,765,908 B1 * 8/2010 Hearn ..... 83/347
2006/0130961 A1 * 6/2006 Byrne et al. ..... 156/159
2008/0150208 A1 6/2008 Elkinson et al.
2008/0200323 A1 * 8/2008 Selle et al. ..... 493/418
2009/0203510 A1 * 8/2009 Kurihara et al. ..... 493/434
2011/0088578 A1 4/2011 Douillard et al.

* cited by examiner

*Primary Examiner* — Hemant M Desai
(74) *Attorney, Agent, or Firm* — Davidson, Davidson & Kappel, LLC

(57) ABSTRACT

An apparatus for transporting folded signatures is provided which includes a first roller and a second roller forming a first nip with the first roller. The first and second rollers each have a compressible outer layer, and are rotatable about respective axes. Preferably, the compressible outer later comprises a microcellular foam. The apparatus also includes a plurality of first transport tapes passing through the first nip and a plurality of second transport tapes passing through the first nip. The plurality of second transport tapes are wrapped at least partially around the second roller so that a signature transported between the first and second transport tapes between the first nip undergoes a change in transport direction as it is transported at least partially around the second roller. Preferably, the signatures enter the first nip perpendicular to a plane passing through the axes of the first and second rollers.

35 Claims, 3 Drawing Sheets

METHOD AND APPARATUS FOR TRANSPORTING SIGNATURES AROUND A ROLL WITHOUT INTRODUCING SKEW

This application relates to the field of printing presses, and in particular to the transport of signatures.

BACKGROUND INFORMATION

In a web printing press, a web or webs may be printed in various printing units. The webs then may enter a folder superstructure. There the webs may be slit into ribbons, which are then superimposed to form a ribbon bundle before passing to a former. The ribbon bundle in the folder superstructure may be drawn over a roller at the top of the former called an RTF by driven nip rolls located after the nose of the former. The ribbon bundle then may pass to folder where the ribbon bundle is cut into signatures.

The signatures can then be transported between a plurality of upper and lower transport tapes for further processing. The upper and lower transport tapes are driven by rollers. During transport, and particularly when the transport direction of the signatures is changed as they pass over roller(s), skew is introduced into the signatures. In general, the skew develops due to the difference in the path length of the inner sheet verses the outer sheet as it passes around a roller.

Commonly owned U.S. Published Patent Application 2008/0150208, entitled "Compressible nip rolls for Multiribbon transport" discusses the use of microcellular rolls for main nips located at the bottom of formers and commonly owned U.S. application Ser. No. 12/587,972, filed Oct. 15, 2009 and entitled "Compressible Roll Top of Former for Multiribbon Transport" discusses the use of microcellular rolls as the nip rollers top of formers (RTF). In both cases, a continuous web passes through the microcellular rolls.

BRIEF SUMMARY OF THE INVENTION

In accordance with a first embodiment of the present invention, an apparatus for transporting folded signatures is provided which includes a first roller and a second roller forming a first nip with the first roller. The first and second rollers each have a compressible outer layer, and are rotatable about respective axes. Preferably, the compressible outer layer comprises a microcellular foam. The apparatus also includes a plurality of first transport tapes passing through the first nip and a plurality of second transport tapes passing through the first nip. The plurality of second transport tapes are wrapped at least partially around the second roller so that a signature transported between the first and second transport tapes and through the first nip undergoes a change in transport direction as it is transported at least partially around the second roller. Preferably, the signatures enter the first nip perpendicular to a plane passing through the axes of the first and second rollers.

In accordance with a second embodiment of the present invention, an apparatus for transporting folded signatures is provided which includes a first roller and a second roller forming a first nip with the first roller, as well as a third roller and a fourth roller forming a second nip with the third roller. The first, second, third and fourth rollers each having a compressible outer layer, and are rotatable about respective axes. Preferably, the compressible outer layer comprises a microcellular foam. The apparatus also includes a plurality of first transport tapes wrapped at least partially around the first and third rollers and a plurality of second transport tapes wrapped at least partially around the second and third rollers so that a signature transported between the first and second transport tapes and through the first nip and the second nip undergoes a change in transport direction as it is transported at least partially around the third roller as it exits the second nip. The signatures may also undergo a change in direction as they exit the first nip. Preferably, the signatures enter the first nip perpendicular to a plane passing through the axes of the first and second rollers, and wherein the signatures enter the second nip perpendicular to a plane passing through the axes of the third and fourth rollers.

In accordance with a third embodiment of the present invention, a folding and transport apparatus is provided which includes a former which imparts a longitudinal fold to a continuous web passing over the former, a pair of cutting cylinders positioned below the former to cut the longitudinally folded web into signatures; and a transport tape assembly for transporting the longitudinally folded signatures. The transport tape assembly is positioned to receive the longitudinally folded signatures with a spine of the signatures substantially parallel with a direction of travel of the signatures. The transport tape assembly includes a first roller and a second roller forming a first nip with the first roller; and a third roller and a fourth roller forming a second nip with the third roller. The first, second, third and fourth rollers each having a compressible outer layer, and are rotatable about respective axes. Preferably, the compressible outer layer comprises a microcellular foam. The tape transport assembly also includes a plurality of first transport tapes wrapped at least partially around the first and third rollers and a plurality of second transport tapes wrapped at least partially around the second and third rollers so that signatures transported between the first and second transport tapes and through the first nip and the second nip undergo a change in transport direction as it is transported at least partially around the third roller after exiting the second nip. The signatures may also undergo a change in direction as they exit the first nip. Preferably, the signatures enter the first nip perpendicular to a plane passing through the axes of the first and second rollers, and wherein the signatures enter the second nip perpendicular to a plane passing through the axes of the third and fourth rollers.

In accordance with a fourth embodiment of the present invention, a method of transporting a signature in a transport direction is provided, comprising: moving signatures in a transport direction between opposing transport tapes with a spine of the signatures parallel to the transport direction. The signatures have an open edge parallel to the transport direction, opposite the spine. The method further comprises passing the signatures, and the opposing transport tapes through a first and second rotating compressible rollers forming a first nip; and wrapping the opposing transport tapes, having the signatures therebetween, around at least a portion of the second roller to change the transport direction of the signatures without introducing skew. Preferably, the signatures enter the first nip perpendicular to a plane passing through the axes of the first and second rollers.

BRIEF DESCRIPTION OF THE DRAWINGS

The present invention will be further described with respect the following Figures, in which.

DETAILED DESCRIPTION OF A PREFERRED EMBODIMENT

Typically, in a web printing press, a continuous web of paper passes through the printing units of the printing press, is slit into a plurality of ribbons, and the ribbons thereafter may be folded longitudinally in a former. The continuous former folded ribbons may then be cut and into signatures and folded in a folder. The folded signatures can then be transported for further processing using transport tapes. In the case of many folders, there is a folded edge on the leading side of a signature. When such a folded signature is transported by transport tapes, this leading folded edge reduces the signatures sensitivity to skew.

Figures 1A, 1B:
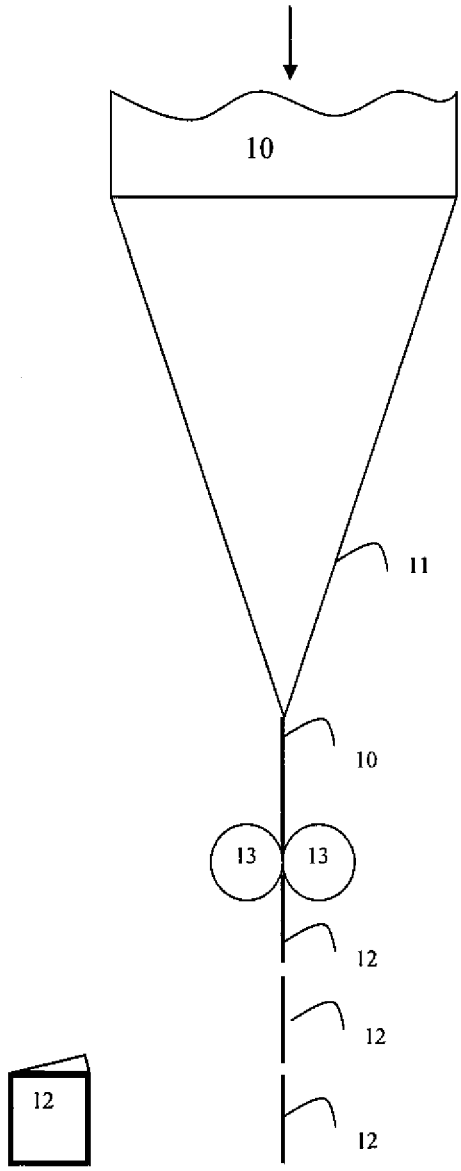
Figure 1B (prior art)
Figure 1A (Prior Art)
FIGS. 1*a* and 1*b* show a former arrangement including a pair of cutting cylinders as is known in the prior art.

In the case of former folders, however, there is usually an open edge on the signatures direction of travel. This open edge is extremely sensitive to skew when the signature turns around a roll. FIG. 1A shows a ribbon 10 passing over a former 11 which imparts a longitudinal fold. From the perspective of FIG. 1, the spine of the longitudinally folded ribbon would be coming out of the page. The longitudinally folded ribbon is cut into folded signatures 12 by cutting cylinders 13. FIG. 1B shows the folded signatures 12 from a perspective that is rotated clockwise 90 degrees from the perspective of FIG. 1A. As illustrated in FIGS. 1A and 1B, there is an open edge (right) and close edge (left) on the signatures 12 in the direction of travel. When these folded signatures travel through transport tape nips, a skew is introduced into the folded signatures as they change direction. For example, it has been found that a skew of approximately 0.190 inches may be introduced for a, 060 inch thick signature using conventional transport tape nips.

In accordance with the embodiments of the present invention, a compressible nip formed by pair of compressible rollers is used to drive the transport tapes through the nip. These tapes preferably enter the nip normal to (in other words at a 90 degree angle to) a plane (or centerline) drawn between the centers (i.e. axes) of the opposing nip rolls and wrap partially one of the nip rolls in order to change direction. The exit angle can be any desired angle relative to the centerline (e.g. 10 degrees, 100 degrees, 50 degrees) that provides a change in direction of the signatures. The direction of wrap is maintained by the tension in the tapes. The speed of the tapes is controlled by the transport characteristics of the compressible nip material. Preferably, the compressible material is microcellular material. When the tapes are in the nip, the nip keeps the tapes traveling the same speed. When signatures are placed between the transport tapes, they travel at the same speed as the tapes. When the tapes and signatures exit the nip at the exit angle, they do so without introducing skew into the signature. In the context of the present invention signature exit "without introducing skew" is defined as signature skew of 0.03 inches or less, and preferably 0.01 inches or less.

Figure 2:
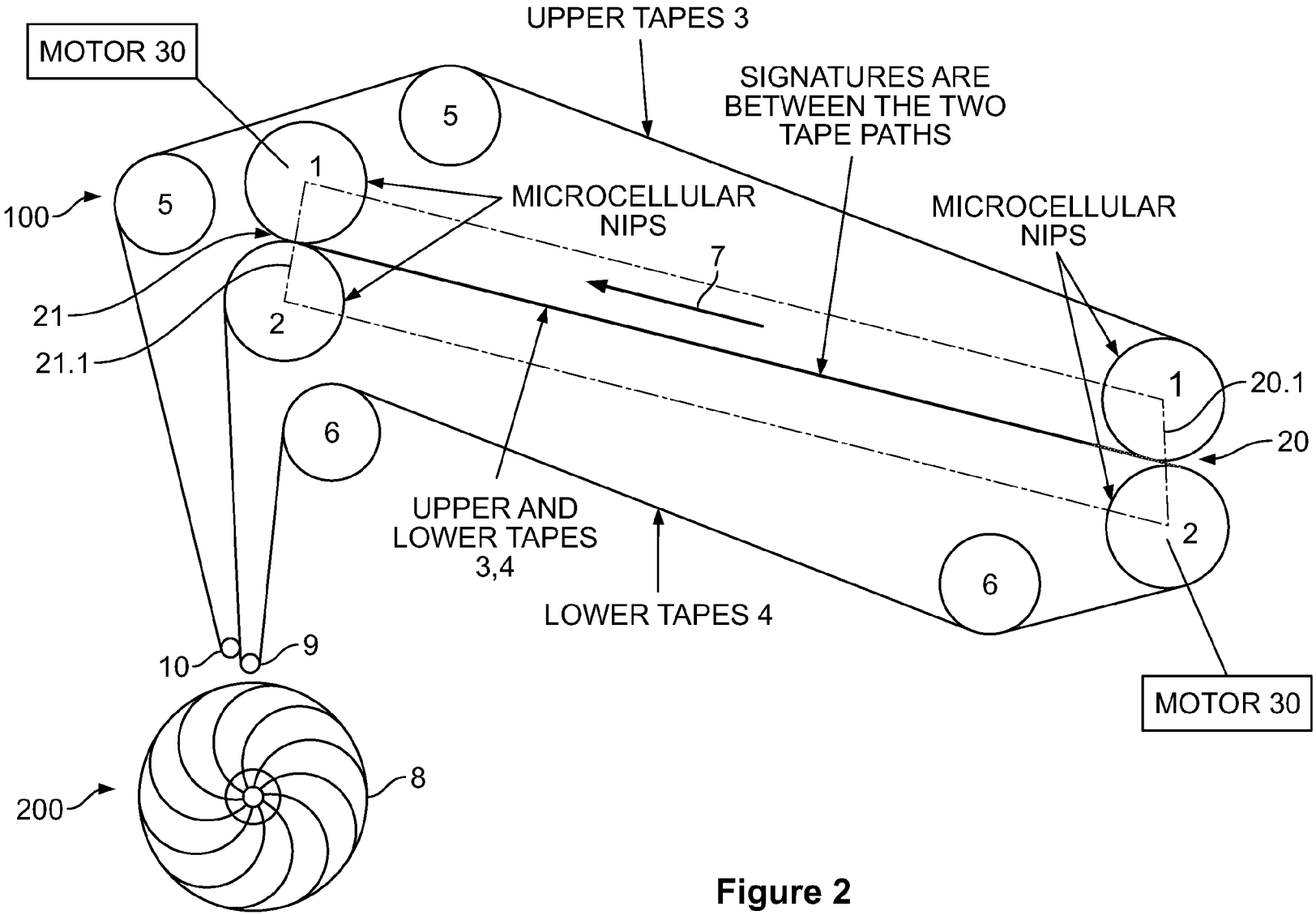
FIG. 2 shows an embodiment of the present invention including two pairs of microcellular nip rolls which transport signatures between a plurality of upper and lower guide belts.

FIG. 2 shows an embodiment of the present invention including a signature transport apparatus 100 which includes two pairs of microcellular nip rolls 1,2 which transport signatures in a direction 7 between a plurality of upper guide tapes 3 and lower guide tapes 4. Upper guide tapes 3 travel around driven nip rolls 1, and non-driven rollers 5 and 10. Lower guide tapes 4 travel around driven nip rolls 2, and non-driven rollers 6 and 9. Signatures enter a nip 20 formed by the rolls 1, 2 on the right side of the figure, and travel between tapes 3,4 to a nip 21 formed by the rolls 1, 2 on the left side of the figure. The signatures are then wrapped around roll 2, and then pass through rollers 9,10 for further processing in a delivery section 200, which, in the exemplary embodiment of FIG. 2, includes a fan wheel 8. Rolls 1, 2 are driven by a motor 30 in any known manner, including for example, gears, belts, or sprockets. Both rolls 1,2 can be connected to the motor 20 by gears, belts, or sprockets, or alternatively, motor 30 can drive one roll 1 or 2 directly, with the other roll driven by a gear. In FIG. 2, a separate motor is provided for each pair of rolls 1, 2. Alternatively, a single motor 30 could drive all four rolls 1, 2.

Figure 3:
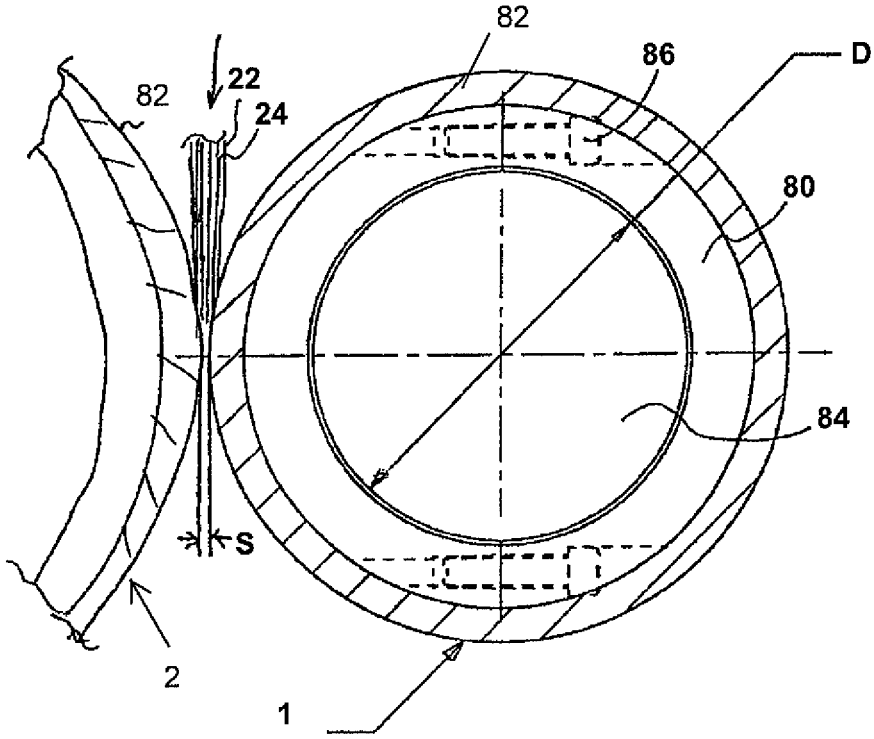
FIG. 3 shows the nip rolls of FIG. 1 in further detail.

FIG. 3 shows nip rolls 1, 2 in more detail. Nip roll 1, which has a body 80, made for example of steel, about which is a compressible outer layer 82 made of for example microcellular foamed urethane of 40 durometer with, for example, a Poisson's ratio of 0.35. Preferably, the Poisson's ratio for the outer layer, which may be made of foamed rubber, or any other suitable material, is 0.5 or less. Preferably, gas inclusions such as air are provided during manufacture of the nip roll. The body 80 for example may be placed in a mold and the urethane foamed around the outer surface of the body to form the outer layer 82. Body 80 may be hollow with an inner diameter D, and may be fixed to axle 80 via screws or bolts 86. Nip roll 2 has the same construction as nip roll 1.

As illustrated in FIG. 2, the tapes enter nip 21 perpendicular to a plane 21.1 passing through the nip centers and wrap around one of the nip rolls, in this case nip roll 2, upon exiting the nip 21 at an angle of approximately 100 degrees relative to the path into nip 21. Similarly, the tapes enter nip 20 perpendicular to the a plane 20.1 passing through the nip centers and wrap partially around roll 1 upon exiting the nip 20 at an angle of approximately 10 degrees relative to the path into the nip 20. The transport properties of the nip formed by the compressible nip rollers 1, 2 allow the signature to change direction as they pass through the nips without introducing skew.

In accordance with further embodiments of the present invention, a relief or groove can be provided in the microcellular material on the roller surface to accommodate each transport tape. The relief or groove on each roller surface should be less than one half combined thickness of the signatures and upper and lower transport tapes so that traction is maintained between the rollers and the tapes.

U.S. patent application Ser. No. 12/587,972, incorporated herein by reference, describes a nip top of former (NTF) with microcellular foam rollers forming the NTF nip. In that application, it is described that when the entry angle is ninety degrees, there are minimal tension differences between the sheets in the ribbon bundle. It also describes that the ribbon bundle can exit the nip at an angle other than zero. However, in the case of the NTF, there is a continuous ribbon exiting the nip and tension in that ribbon allows the ribbon path to follow an exit angle out of the nip. If signatures, instead of a continuous ribbon, were fed into the nip, there would be no mechanism available to ensure that the signatures exit the nip at a pre-defined angle. In accordance with the embodiments of the present invention, the signatures enter a microcellular signature transport nip between transport tapes, thereby avoiding the skew that would be introduced with conventional, non-compressible, transport nip rollers.

In accordance with further embodiments of the present invention, a folding and transport apparatus can be provided including a former in which the NTF can be formed with microcellular foam rollers, and further including the transport apparatus described above including transport tapes and microcellular nip rollers.

Although the embodiments of the present invention have been described above with respect to processing a signature with an open edge leading because an open edge leading product is more prone to skew in conventional applications than a folded edge leading product, the embodiments of the present invention can also be used in connection with folded edge leading products, and would serve to reduce the skew in those products in the same manner described above with regard to open edge leading products.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An apparatus for transporting folded signatures in a transport direction, comprising:

a first roller;

a second roller forming a first nip with the first roller, the first and second rollers each having a compressible outer layer, the first and second rollers rotatable about respective axes;

a first and second downstream rollers located downstream of the first nip in the transport direction, the first and second downstream rollers forming a downstream nip;

a plurality of first transport tapes passing through the first nip and the downstream nip and a plurality of second transport tapes passing through the first nip and the downstream nip, the first and second transport tapes entering the first nip along a path;

the plurality of first transport tapes and the plurality of second transport tapes wrapped at least partially around the second roller, the plurality of first and second transport tapes traveling between the second roller and the downstream nip at an angle relative to the path, wherein a signature transported between the first and second transport tapes and through the first nip undergoes a change in transport direction as it is transported at least partially around the second roller.

2. The apparatus of claim 1, wherein the path is perpendicular to a plane passing through the axes of the first and second rollers.

3. The apparatus according to claim 1, further comprising at least one motor for rotating the first and second rollers.

4. The apparatus according to claim 1 wherein the compressible outer layer is made of a foamed material.

5. The apparatus according to claim 1, wherein the compressible outer layer is made of a microcellular foam.

6. The apparatus according to claim 5, wherein the microcellular foam has Poisson's ratio of 0.50 or less.

7. The apparatus according to claim 1 wherein the compressible outer layer has a Poisson's ratio of 0.50 or less.

8. The apparatus according to claim 1, wherein the compressible outer layer is made of urethane with gas inclusions.

9. The apparatus according to claim 1 wherein the compressible outer layer is made of rubber with gas inclusions.

10. The apparatus of claim 1, further comprising grooves in an outer surface of the first and second rollers for receiving the first and second transport tapes.

11. An apparatus for transporting folded signatures in a transport direction, comprising:

a first roller;

a second roller forming a first nip with the first roller;

a third roller;

a fourth roller forming a second nip with the third roller, the first, second, third and fourth rollers each having a compressible outer layer, the first, second, third, and fourth rollers rotatable about respective axes, the second nip downstream of the first nip in the transport direction;

a first and second downstream rollers located downstream of the second nip in the transport direction, the first and second downstream rollers forming a downstream nip;

a plurality of first transport tapes wrapped at least partially around the first and third rollers;

a plurality of second transport tapes wrapped at least partially around the second roller and the third roller, the plurality of first and second transport tapes passing through the first, second and downstream nips, the plurality of first and second transport tapes entering the second nip along a path, the plurality of first and second transport tapes traveling between the third roller and the downstream nip at an angle relative to the path, wherein a signature transported between the first and second transport tapes and through the first nip and the second nip undergoes a change in transport direction as it is transported at least partially around the third roller after exiting the second nip.

12. The apparatus of claim 11, wherein the signatures enter the first nip perpendicular to a plane passing through the axes of the first and second rollers, and wherein the signatures enter the second nip perpendicular to a plane passing through the axes of the third and fourth rollers.

13. The apparatus of claim 11, wherein the signatures undergo a change in direction as they exit the first nip.

14. The apparatus according to claim 11, further comprising at least one motor for driving the first, second, third, and fourth rollers.

15. The apparatus according to claim 14, wherein a first motor drives the first and second rollers, and a second motor drives the third and fourth rollers.

16. The apparatus according to claim 11, further comprising at least one motor for driving the first and third rollers.

17. The apparatus according to claim 11, further comprising a first motor for driving the first roller, and a second motor for driving the third roller.

18. The apparatus according to claim 11 wherein the compressible outer layer is made of a foamed material.

19. The apparatus according to claim 18, wherein the foamed material comprises microcellular foam having a Poisson's ratio of 0.50 or less.

20. The apparatus according to claim 11 wherein the compressible outer layer has a Poisson's ratio of 0.50 or less.

21. The apparatus according to claim 11, wherein the compressible outer layer is made of urethane with gas inclusions.

22. The apparatus according to claim 11, wherein the compressible outer layer is made of rubber with gas inclusions.

23. The apparatus of claim 11, further comprising grooves in an outer surface of the first, second, third and fourth rollers for receiving the first and second transport tapes.

24. A folding and transport apparatus comprising:

a former, the former imparting a longitudinal fold to a continuous web passing over the former;

a pair of cutting cylinders positioned below the former to cut the longitudinally folded web into signatures; and a transport tape assembly for transporting the longitudinally folded signatures, the transport tape assembly positioned to receive the longitudinally folded signatures with a spine of the signatures substantially parallel with a direction of travel of the signatures, the transport tape assembly including:

a first roller;

a second roller forming a first nip with the first roller a third roller;

a fourth roller forming a second nip with the third roller, the first, second, third and fourth rollers each having a compressible outer layer, the first, second, third, and fourth rollers rotatable about respective axes, the second nip downstream of the first nip in the transport direction;

a first and second downstream rollers located downstream of the second nip in the transport direction, the first and second downstream rollers forming a downstream nip;

a plurality of first transport tapes wrapped at least partially around the first and third rollers;

a plurality of second transport tapes wrapped at least partially around the second roller and the third roller, the plurality of first and second transport tapes passing through the first, second and downstream nips, the plurality of first and second transport tapes entering the second nip along a path, the plurality of first and second transport tapes traveling between the third roller and the downstream nip at an angle relative to the path, wherein signatures transported between the first and second transport tapes and through the first nip and the second nip undergo a change in transport direction as it is transported at least partially around the third roller after exiting the second nip.

25. The apparatus of claim 24, wherein the signatures undergo a change in direction as they exit the first nip.

26. The apparatus of claim 24, wherein the signatures enter the first nip perpendicular to a plane passing through the axes of the first and second rollers, and wherein the signatures enter the second nip perpendicular to a plane passing through the axes of the third and fourth rollers.

27. The apparatus according to claim 24, further comprising at least one motor for driving the first, second, third, and fourth rollers.

28. The apparatus according to claim 24, further comprising at least one motor for driving the first and third roller's.

29. The apparatus according to claim 24 wherein the compressible outer layer is made of a foamed material.

30. The apparatus according to claim 24, wherein the compressible outer layer is made of a microcellular foam.

31. The apparatus according to claim 24 wherein the compressible outer layer has a Poisson's ratio of 0.50 or less.

32. The apparatus of claim 24, further comprising grooves in an outer surface of the first, second, third and fourth rollers for receiving the first and second transport tapes.

33. A method of transporting a signature in a transport direction, comprising:

moving signatures in a transport direction between opposing transport tapes with a spine of the signatures parallel to the transport direction, the signatures having an open edge parallel to the transport direction, opposite the spine;

passing the signatures, and the opposing transport tapes through a first and second rotating compressible rollers forming a first nip; and wrapping the opposing transport tapes, having the signatures therebetween, around at least a portion of the second roller to change the transport direction of the signatures without introducing skew.

34. The method according to claim 33, further comprising passing the signatures and opposing transport tapes through a third and fourth compressible rollers forming a second nip and wrapping the opposing transport tapes, having the signatures therebetween, around at least a portion of the third roller to change the transport direction of the signatures without introducing skew.

35. The method of claim 34, wherein the first and second rollers rotate about respective axes, and wherein the signatures enter the first nip perpendicular to a plane passing through the axes of the first and second rollers.

* * * * *

UNITED STATES PATENT AND TRADEMARK OFFICE

CERTIFICATE OF CORRECTION

PATENT NO. : 8,506,466 B2
APPLICATION NO. : 13/159909
DATED : August 13, 2013
INVENTOR(S) : Gerald Roger Douillard, David Elliot Whitten and David Clarke Pollock It is certified that error appears in the above-identified patent and that said Letters Patent is hereby corrected as shown below:

In the Claims

Col. 5, line 49, Claim 6 should read

"The apparatus according to claim 5, wherein the microcellular foam has a Poisson's ratio of 0.50 or less."

instead of

"The apparatus according to claim 5, wherein the microcellular foam has Poisson's ratio of 0.50 or less."

Signed and Sealed this
Twenty-eighth Day of January, 2014

Michelle K. Lee

Michelle K. Lee
*Deputy Director of the United States Patent and Trademark Office*